United States Patent [19]

Torre

[11] 4,265,187

[45] May 5, 1981

[54] APPARATUS FOR APPLYING ELASTIC RINGS TO TUBULAR GARMENTS

[75] Inventor: Giancarlo D. Torre, Milan, Italy

[73] Assignee: Rockwell-Rimoldi, S.p.A., Biassono, Italy

[21] Appl. No.: 44,884

[22] Filed: Jun. 4, 1979

[30] Foreign Application Priority Data

Jun. 15, 1978 [IT] Italy ..... 24590 A/78

[51] Int. Cl.[3] ..... D05B 21/00

[52] U.S. Cl. ..... 112/121.26

[58] Field of Search ..... 112/121.26, 121.27, 112/121.29, 121.15, 121.11, 2

[56] References Cited

U.S. PATENT DOCUMENTS

| | | | |
|---|---|---|---|
| 1,723,781 | 8/1929 | Hoggard | 112/121.26 |
| 3,310,014 | 3/1967 | Tucci | 112/121.26 X |
| 3,783,805 | 1/1974 | Guichard | 112/121.26 X |
| 3,865,058 | 2/1975 | Rovin et al. | 112/121.76 X |
| 4,098,201 | 7/1978 | Adamski et al. | 112/121.26 X |
| 4,191,117 | 3/1980 | Della Torre | 112/121.26 X |

*Primary Examiner*—H. Hampton Hunter

[57] ABSTRACT

An improved apparatus for applying elastic rings to tubular garments having a supporting frame within which a sewing machine is mounted. Above the sewing machine the frame supports an elongated movable structure having a piece-carrier mounted on each end thereof. The apparatus includes a loading zone and a sewing zone and control devices for simultaneously moving the piece-carriers to and from the sewing and loading zones and for reversing the positions of the piece-carriers to alternately position them in each of the two zones.

9 Claims, 6 Drawing Figures

APPARATUS FOR APPLYING ELASTIC RINGS TO TUBULAR GARMENTS

BACKGROUND OF THE INVENTION

The present invention relates to an apparatus for applying an elastic ring to tubular garments such as underpants which includes in combination a sewing machine mounted on a stationary stand with a movable structure supporting spaced apart units of so-called piece-carriers, i.e., devices on which the garments and elastic rings are placed prior to their being presented to the sewing machine. The apparatus also includes actuating means for effecting movement of the movable structure with respect to the sewing machine so as to sequentially move each piece-carrier unit from a loading position to a position of operative association with the stitching instrumentalities of the sewing machine. This actuating means is also effective while moving one unit from the loading zone in simultaneously moving another unit from the sewing zone so as to effect doffing of the sewn garment therefrom.

Apparatuses for performing this function are well known in the sewing art, but they are considered somewhat complex and rather cumbersome, for they are more commonly formed by circular structures with the piece-carrier units being mounted on the periphery of such structures and with the sewing machine occupying a sector of somewhat reduced area. In particular, the sewing machine is disposed so as to present its sewing zone tangential to the periphery of such known apparatuses to effect engagement at timed intervals with the garments and their respective pieces of elastic being supported by such piece carrier units.

In some of the known apparatuses the sewing machines occupy a narrow sector which is disposed internally of the pathway which the piece-carrier units are caused to follow and are arranged to move radially inward toward the axis of the circular structures to effect disengagement from a garment that has been sewn thereby permitting its removal from the apparatus.

Other known apparatuses utilize additional sewing machines which are located externally of the circular structure that support the piece-carrier units and serve to perform successive sewing operations on the same garment. It can be easily understood that the sewing machines are movably mounted on the circular structure type apparatus for they form a relatively small part thereof and are more practical to displace before and after each sewing operation.

The placement of the elastic ring on the tubular garment is a manual operation with the known apparatuses which results in its positioning not being consistently accurate and uniform. When the elastic ring is required to be concealed beneath a folded over edge of a garment, its positioning on the garment should be performed in a precise manner relative to said edge so as to avoid damage to said ring during the seaming cycle by the stitching instrumentalities of the machine.

The importance of accurate positioning of the elastic ring in known apparatuses is considered a very important factor for the sewing machines that commonly form a part of said apparatuses do not utilize the auxiliary attachments to effect an accurate and automatic foldover of the edge of the garment or which serve as a guide means for the elastic ring. It is obvious that these attachments are avoided so as to prevent complicating the operating procedures of presenting to and removal of the garments from the stitching instrumentalities.

For reasons set forth above it is readily understandable that the complications and difficulties are not easily avoided which are encountered when applying elastic rings to tubular garments on apparatuses of the prior art, and requires what is considered an excessive amount of an operator's time to minimize such problems.

An object of the present invention is to provide an improved apparatus for applying elastic rings to tubular garments which requires less space to perform its intended function than prior art apparatuses. Relative to the prior art apparatuses the invention provides improved performance by consistently and accurately ensuring positive positioning of the elastic rings as well as a means, when required, for folding over the garment edge prior to withdrawing the piece-carrier from the loading zone.

SUMMARY OF THE INVENTION

The object of the invention is accomplished by providing an apparatus with a movable structure for supporting the piece-carrier units that carry the garments to be sewn and which has a length greater than the sewing machine with which it is operatively associated. The apparatus is of lightweight construction and is capable of performing all the necessary functions of moving a piece-carrier unit from a loading position to a sewing position and then returning the unit to said loading position for repeating the cycle. Additionally, all the functions the unit is capable of performing are automatized in the simpliest and most efficient way in order to reduce the operator's workload.

The movable structure for the apparatus is formed by two rectilinear elements fixed on a support plate that is pivotably mounted on the underside of a plate element mounted for sliding movement on a pair of rectilinear guide and support members which extend parallel to and in spaced relation above the sewing machine. The movable structure is mounted on a support structure which in turn extends upwardly from a stationary support stand. Sliding movement of the plate element on the rectilinear guide and support means causes the movable structure to move longitudinally relative to the sewing machine which is fixedly mounted on the support stand. Piece-carrier units are assembled on opposite ends of the rectilinear guide and support members and longitudinal movement of this structure is effective in simultaneously moving said units so that when one is moving either toward or away from operative association with the sewing machine, the opposite one is moving either toward or away from a position for receiving the next garment to be sewn.

With the support plate being pivotably attached to the underside of the plate element, a means is provided whereby the positions of the piece-carrier units can be reversed so that the one with the next garment to be sewn will be in a position of operative association with the sewing machine and the other in a position for receiving another garment. To effect the required movements of the piece-carrier units a first actuating means is mounted on the support structure and is operative connected with the plate element so as to provide longitudinal displacements thereof and a second actuating means carried by the plate element and connected to the moveable structure provides the necessary motion for reversing the positions of said piece-carrier units.

A particular advantage of the apparatus according to the invention is the positive and effective manner of alternately manipulating the opposed piece-carrier units between sewing and loading positions and a means operatively associated with a position for placing a garment on a piece-carrier unit which accurately positions an elastic ring onto a garment prior to folding an edge of the latter over said elastic ring.

Another improved feature of the invention is the piece-carriers which are formed by a horizontal cross member having a pair of spaced and depending legs which include a cylindrical element rotatably carried adjacent the upper and lower end of each leg and serve to support and permit rotation of the garment during the seaming operation. The space intermediate the lower ends of the depending legs is sufficient to straddle the sewing machine and facilitates presenting and the removal of a garment from the sewing zone of a machine.

In the loading zone each of the cylindrical elements of a piece-carrier are disposed in operative association with a sliding support element that are effective in acurately locating a ring of elastic onto a garment which has been loaded or placed on said cylindrical elements.

Other objects and advantages of the invention will become more fully apparent by reference to the appended claims and as the following detailed description proceeds in reference to the figures of drawing wherein:

DESCRIPTION OF THE PREFERRED EMBODIMENT

Figure 1:
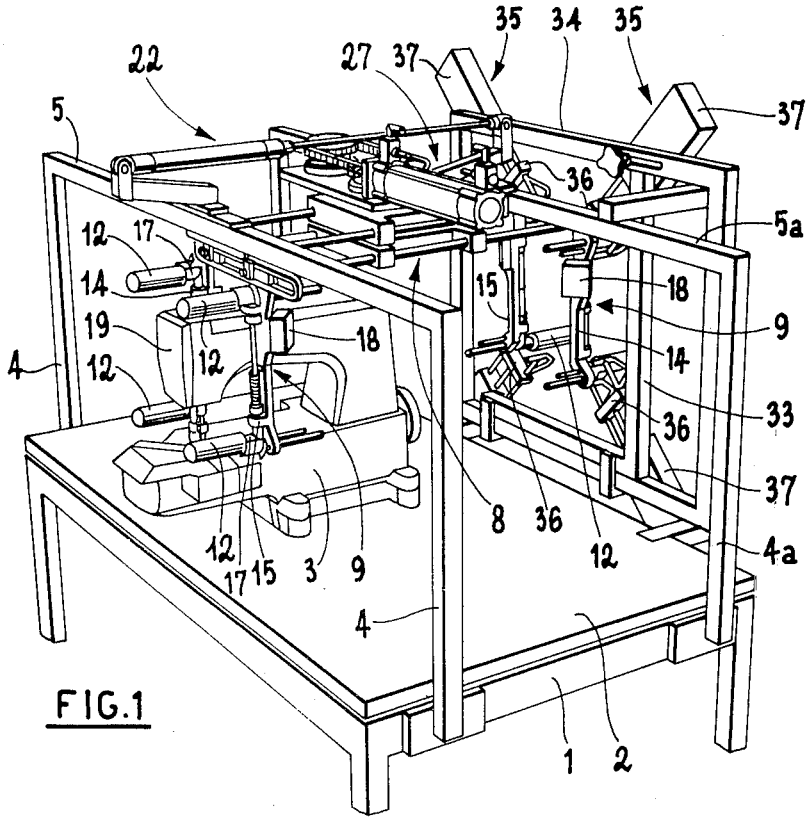
FIG. 1 is a perspective view of the apparatus according to the invention as seen looking from the front thereof.
Figure 3:
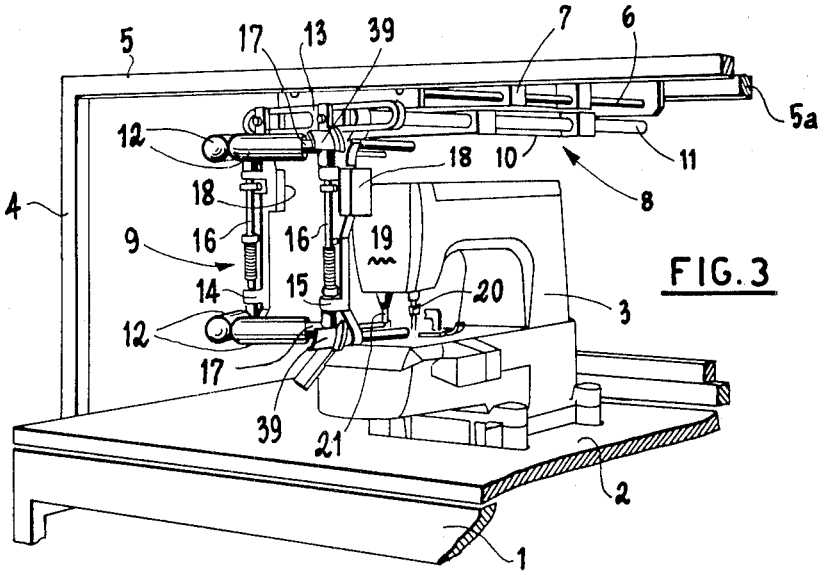
FIG. 3 is a view similar to that of FIG. 1 showing the cylindrical elements of a piece-carrier in position to effect removal of a garment therefrom.
Figure 2:
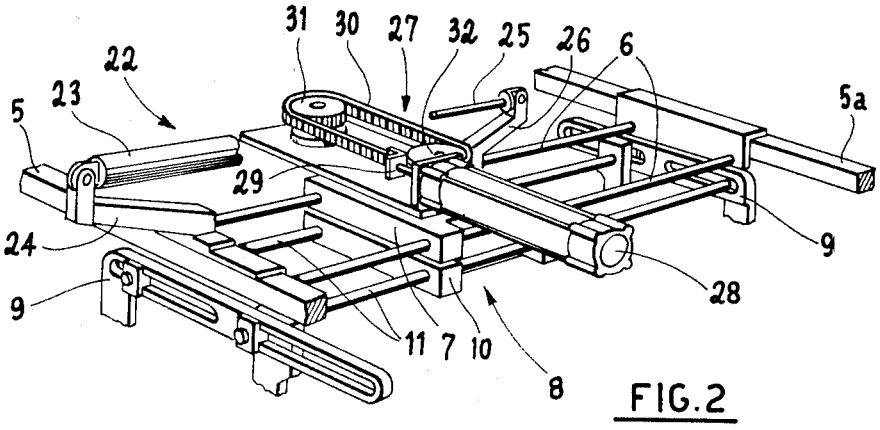
FIG. 2 is a perspective view showing further detail of the actuating means shown on the upper portion of the apparatus in FIG. 1.

With reference to FIGS. 1, 2 and 3, the apparatus for applying an elastic ring to tubular garments, such as underpants, has a supporting frame with the lower portion thereof being formed by a support stand 1 having a planar support surface 2, on which a sewing machine 3 of the cylindrical or free base type is mounted. Extending upwardly from the support surface 2 the apparatus includes a forward pair of spaced uprights 4 and a rearward pair identified by numeral 4*a*. The upper ends of these uprights 4 and 4*a* are interconnected by crossbars 5 and 5*a*, respectively, which together define a support structure above the sewing machine. A pair of spaced cylindrical bars 6 are fixedly attached to and traverse the distance between the crossbars 5 and 5*a* and provide a means for supporting a plate 7 for sliding movement on said bars 6. Plate 7 forms a part of a movable structure generally indicated by numeral 8 that has a piece-carrier unit mounted on each end thereof which are identified generally by numeral 9. The cylindrical bars 6 being disposed in spaced relation above the sewing machine are arranged so as to extend parallel with the longitudinal axis of said machine.

The movable structure 8 is pivotably supported on the underside of plate 7 by means of a support plate 10 which includes a pair of spaced apart cylindrical bars 11 fixed therein which extend from opposite sides thereof in parallel relationship and serve to support the above mentioned piece-carrier units 9 on their opposite ends.

These piece-carrier units 9 are vertically disposed and define a substantially rectangular structure having a cylindrical element 12 rotatably mounted at each corner of said structure which serve to support a tubular garment thereon and the elastic ring to be attached to said garment.

More particularly, each piece-carrier unit 9 is formed by a horizontal crossbar 13 having a pair of spaced depending support legs 14 and 15 with leg 14 being fixed to one end of said crossbar and leg 15 being adjustably located adjacent the opposite end. A vertically extending shaft 16 is pivotably mounted on the outer surface of each support leg 14 and 15 and the upper and lower ends thereof extend horizontally as at 17 to provide a means for rotatably supporting the cylindrical elements 12.

With the support leg 15 being adjustable along the length of the crossbar 13 provides a means whereby the spacing between the cylindrical elements 12, carried by both depending support legs, can be varied so as to accommodate various styles and sizes of garments to be sewn.

Actuating devices 18, such as electric or fluid actuated linear motors, are mounted on each support leg 14 and 15 in operative association with each shaft 16 and are effective in turning said shafts in a direction to cause the cylindrical elements 12 carried on one shaft to pivot toward those carried on the other (FIG. 3). This pivotal movement of the cylindrical elements 12 cancels the supporting and tensioning action of the latter and provides a means for releasing a garment therefrom on which the stitching operation has been completed.

The minimum distance between the depending support legs 14 and 15 is sufficient to permit the latter to straddle the sewing machine, having a conventional needle bar 20 and presser device 21, when the piece carrier unit 9 is caused to be moved into operative association with said sewing machine (FIG. 1).

The structure of the piece-carrier units 9 permits the cylindrical elements 12 forming a part thereof to be moved into close proximity with each side of the head 19 of the sewing machine as shown in FIG. 1 and are effective in guiding the tubular garment so that it is rotated with a minimum of resistence while being advanced through the sewing zone of said machine.

Figure 4:
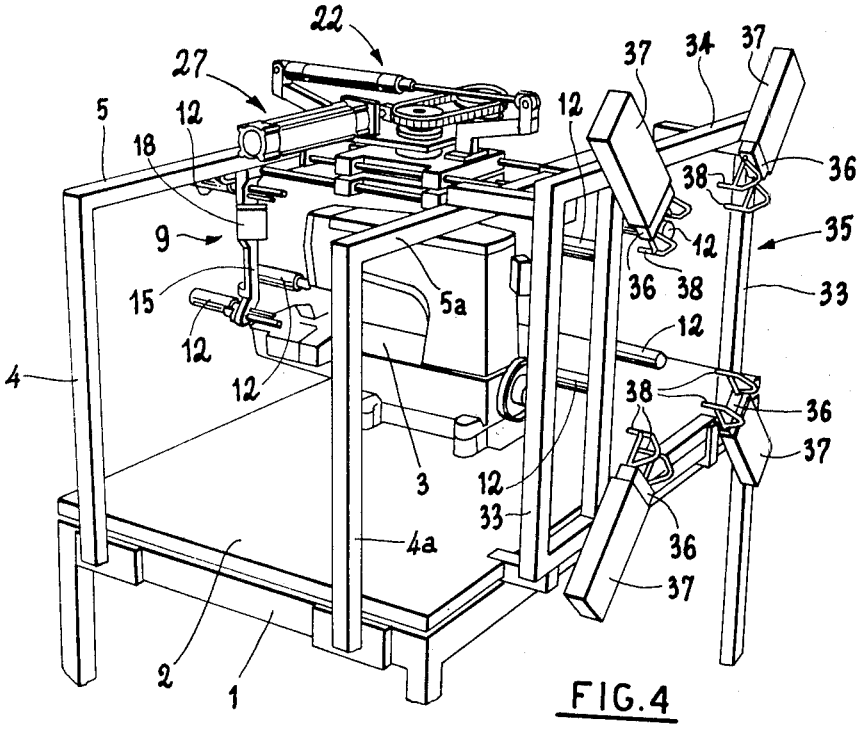
FIG. 4 is a perspective view of the garment loading zone of the apparatus as seen looking from the rear thereof.

A first actuating means identified generally in FIGS. 1, 2 and 4 by numeral 22 is mounted on the crossbar 5 of the support structure and serves to effect forward and rearward movement of the movable structure 8 with respect to the sewing machine 3.

The first actuating means includes a pneumatic cylinder 23 one end of which is pivotably connected to a bracket 24 that is fixed by any suitable means to the crossbar 5 and its piston rod extending from the opposite end is depicted by numeral 25. The outer end of the piston rod 25 is pivotably connected to a bracket 26 that extends upwardly from and which is fixedly mounted on the upper surface of plate 7.

A second actuating means identified generally in FIGS. 1, 2 and 4 by numeral 27 is also mounted on the upper surface of plate 7 and provides a means for rotating the movable structure 8 180° in one direction or the other relative to the fixed position of the sewing machine 3.

As more clearly shown in FIG. 2 the second actuating means 27 on the plate 7 includes a pneumatic cylinder 28 having a piston rod 29 operatively connected to a flexible drive belt 30. This drive belt 30 interconnects a pair of spaced pulley elements 31 and 32 with the latter being fixed on the upper end of a vertical shaft (not shown) which extends through an opening in the plate 7 and with the lower end thereof being operatively connected to the support plate 10.

With the manner in which the second actuating means 27 is caused to function, each actuation of the pneumatic cylinder 28 effects movement of the drive belt and rotation of the pulley elements 31 and 32 a sufficient distance to cause the latter to effect rotation of the movable structure 8 a distance which will reverse the positions of the piece-carriers 9.

Referring now to FIGS. 1 and 4 the rearward side of the apparatus has a vertically disposed auxiliary structure assembled thereon which includes a pair of spaced uprights 33 that are interconnected by a horizontal crossbar 34. This structure serves to support a loading means identified generally by numeral 35 which includes two pair of opposed sliding elements 36 having conventional type actuators 37 such as electric or fluid actuated linear motors.

The auxiliary structure is of generally rectangular configuration and the actuators 37, which correspond in number to the number of cylindrical elements 12, are mounted on each corner of said structure. These actuators 37 are mounted in a manner whereby their respective sliding elements 36 are caused to more diagonally inward so as to be in operative association with a cylindrical element 12 when a piece-carrier is in its garment loading position. As more clearly shown in FIG. 4, the free ends of each sliding element 36 includes a pair of spaced apart hook-like members with the terminus portions thereof defining a pair of parallel and horizontally extending support fingers 38.

With the actuators 37 and their respective sliding elements 36 being mounted as described a sufficient clearence remains in the central area of the auxiliary structure to receive a piece-carrier unit 9. When a piece-carrier is in this position acutuation of the actuators 37 causes the sliding elements 36 to move inwardly to a position whereat each of the support fingers 38 is caused to straddle a cylindrical element 12 when a piece-carrier is in loading position. In FIG. 4 the sliding elements 36 are shown in their retracted positions.

To effect loading of a piece-carrier unit 9, the sliding elements 36 are first caused to move inwardly prior to movement of said piece-carrier to its loading position and while at their inner position a ring of elastic 43 is placed so as to be in contact with the outer surface of support fingers 38. After the ring of elastic is placed on the support fingers 38, the sliding elements 36 are retracted from their inner position so that a piece-carrier 9 may move into this position which defines the garment loading zone. Movement of a piece-carrier unit into the loading zone causes simultaneous movement of the other piece-carrier into a position of operative association with the sewing machine for effecting the attachment of a ring of elastic to the garment carried thereby. In the loading zone a tubular garment having its inner surface turned outwardly is placed on the piece-carrier so as to be in contact with the outer surface of each cylindrical element 12 and is placed thereon so that the end or edge thereof is located on a turnover element 39 with which each of said cylindrical elements 12 is provided. These turnover elements 39 serve to effect the folding over of the edge of the garment onto the ring of elastic which is deposited onto the garment by causing the sliding elements 36 to once again move to their inner positions.

The seaming and loading operations are performed simultaneously and with both being completed at the same time, a single longitudinal movement of the movable structure 8 by the first actuating means 22 is effective in moving both piece-carriers so that the sewn garment is removed from the sewing zone and the other from the loading zone.

After the movable structure has been moved by the first actuating means 22, the second actuating means 27 is effective in rotating said structure 180° so that the positions of the piece-carrier units are reversed.

Figure 5:
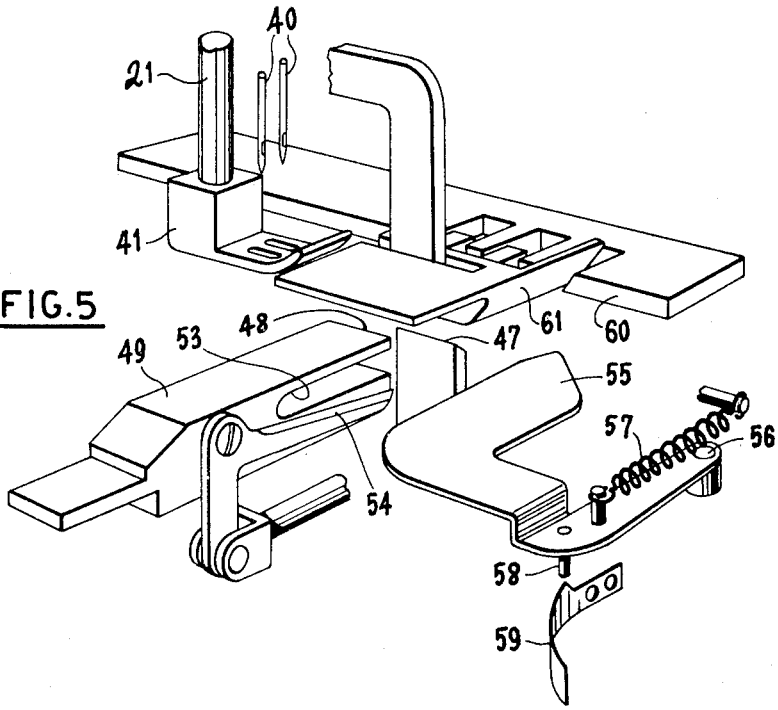
FIG. 5 is a perspective view of the garment trimming and sensing devices operatively associated with the sewing zone of the apparatus.
Figure 6:
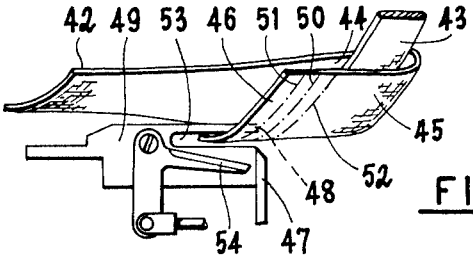
FIG. 6 is a view in side elevation and partially in perspective showing the relationship of a garment with the trimming device in the sewing zone.

Referring now to FIGS. 5 and 6 the various elements in the sewing zone which act upon the garment during the seaming operation will now be described. In this zone the sewing machines includes a conventional needle bar 20 that carries a pair of needles 40 and a presser device 21 with a presser foot 41 which cooperates in a known manner with feed dogs (not shown) to effect advance of a garment 42 during the seaming operation.

As heretofore described a ring of elastic 43 is deposited onto the exterior of a garment which was positioned on the cylindrical elements 12 so as to be in contact with the outer surface of each and more particularly said ring is deposited in a position 44 on the garment which is at a predetermined distance from the edge 46 of said garment. The edge 46 is folded over the ring of elastic by the turnover elements 39 and forms a band 45 (FIG. 6) prior to the piece-carrier leaving the loading zone. In the sewing zone the folded edge of the garment is sewn to the adjacent surface of said garment which completes the seaming operation by concealing the ring of elastic within the band 45.

During the seaming operation the edge 46 of the folded band 45 is caused to be trimmed by a conventional cutting blade 47 that is operatively associated with a counter-blade 48 which is integrally formed on the forward portion of a slidably mounted support block 49.

The cutting line of the cutting blade 47 is depicted in FIG. 6 by numeral 50 and is disposed in alignment with the space between the needles 40 so that one of the latter follows a pathway 51 located to the left of said cutting line, and the other follows a pathway 52 to the right.

The support block 49 is movable away from the cutting blade 47 which serves to permit the edge 46 to be interposed between said blade 47 and the counter-blade 48 which as shown in FIG. 6 must be inserted between the body portion of the garment 42 and the folded over band 45. To facilitate this insertion of the counter-blade 48 the support block 49 is provided with an elongated recess 53 which is adapted to receive the edge 46 that will be severed from the garment.

To prevent the trimming operation from producing a ring of fabric which would be troublesome in discarding the same from the body portion of the garment 42, the support block 49 is provided with a transverse blade 54 that is actuated by conventional means not shown and serves to cut the edge 46 at the beginning of the sewing operation.

As described above, the garment to be sewn is carried in front of the sewing machine by one of the piece-carrier units 9 and then inserted into the sewing zone. At this point, the support block 49 is caused to advance to effect insertion of its counter blade 48 between the body portion of the garment 42 and the latter's edge 46. After the cut is made by the transverse blade 54, the trimming and sewing operations commence simultaneously.

As is well known to those conversant with the art of circular sewing, the initial portion of a seam is presented a second time in front of the needles upon completion of a seam about the workpiece. For this reason it is necessary near the end of the seaming cycle to withdraw the support block 49 from the path of the seam so as to prevent an interference with said block. To initiate withdrawal of the support block 49, a sensor element 55 is provided which is located forwardly of said block which is in the direction of displacement of the seam, and performs its function at a location intermediate the body portion of the garment 42 and the folded over band 45.

The sensor element 55 is movable with the support block 49 and thus is displaced longitudinally with it towards and away from the seam being made, and is pivotably mounted on a pin 56 so as to be pivoted away from the seam upon initial contact therewith. When the seam makes contact with the sensor element 55 it is effective in pushing the latter causing it to pivot on the pin 56 against a biasing force of a coil spring 57 and pivots said sensor element to an inoperative position.

This coil spring 57 serves to maintain the sensor element 55 in its operative position and especially when the workpiece may possess such obstacles as cross seams and labels, i.e., elements present on the garment which are capable of exerting a limited amount of pressure on said sensor element but which is insufficient to cause its displacement.

In its inoperative position, the sensor element initiates actuation of a conventional form of drive means (not shown) which is adapted to withdraw the support block 49 from the path of a seam. Withdrawal of the support block in this manner is also effective in displacing the sensor element even though it had been previously rotated and is thereby located in a position free from interference with the seam.

The sensor element is operatively connected to the first actuating means 22 and upon reappearance of the initial part of the seam, they are timed to be activated to effect removal of the piece-carrier unit then in the sewing zone. To be repositioned in its operative position, the sensor element 55 is provided with a depending peg 58. This peg 58 is adapted to make contact with a flexible arcuated plate member 59 fixed on the sewing machine and serves to pivot the sensor element on its pin 56 so as to again position it in the path of the seam during the forward movement of the support block at the beginning of each cycle. The sewing machine further includes a conventional straight guide 60 located in operative association with its sewing zone and provides a means for maintaining the garment 42 aligned with the needles 40.

There is also provided a supplementary foot 61 that is disposed above the cutting blade 47 and serves to maintain the garment and the ring of elastic being attached thereto in a desirable position with respect to the cutting knife, and in this way prevents a possible, and undesired, escape of the edge 46 from the elongated recess 53.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. An apparatus for applying elastic rings to tubular garments of the type having a supporting frame with a sewing machine mounted therein and with opposed piece-carriers that are alternately movable between a position of garment loading and a sewing zone position for effecting a seaming operation by the sewing machine on the garment carried thereby said apparatus comprising:

(a) a movable structure (8) mounted on the supporting frame above the sewing machine having a piece carrier unit (9) assembled on each end thereof;

(b) a first actuating means (22) connected to said movable structure (8) for effecting longitudinal movement thereof and for simultaneously moving one of said piece-carriers to and from a loading means (35) and the other to and from the sewing zone;

(c) a second actuating means 27 connected to said movable structure (8) for rotating the latter to effect a reversal of positions of said piece-carriers units (9) after movement of the latter from said loading means (35) and the sewing zone by said first actuating means (22).

2. The apparatus according to claim 1 wherein said movable structure includes:

(a) a pair of spaced cylindrical bars (6) fixed to the supporting frame having a plate (7) slidably mounted on said cylindrical bars (6) and operatively connected to said first actuating means (22) and (b) a support plate (10) operatively connected to said second actuating means and rotatably mounted on the underside of said plate (7) having a pair of spaced cylindrical bars (11) fixed therein and extending from opposite sides thereof for supporting said piece-carriers (9) on the ends of said bars (11).

3. The apparatus according to claim 2 wherein said second actuating means includes:

(a) a pair of spaced pulley elements (31, 32) with the latter being operatively connected to said support plate (10);

(b) a flexible drive belt (30) interconnecting said pulley elements (31, 32); and (c) a pneumatic cylinder (28) having a piston rod (29) connected to said drive belt (30) for rotating said pulley elements (31, 32) and said movable structure (8) a distance to effect reversal of the positions of said piece carriers (9).

4. The apparatus according to claim 2 wherein said piece-carrier unit (9) includes:

(a) a horizontal crossbar (13) interconnecting the ends of said cylindrical bars (11);

(b) a pair of spaced support legs (14, 15) connected to and depending from said crossbar (13);

(c) a vertically disposed shaft (16) pivotably mounted on each said support legs (14, 15);

(d) means forming the ends of said shaft (16) for rotatably supporting a cylindrical element (12) in a horizontal plane, said cylindrical elements providing means for supporting a tubular garment for rotating movement in the sewing zone; and (e) means operatively associated with each of said shafts (16) for pivoting the same and said cylindrical elements to effect release of a garment upon completion of the seaming operation.

5. The apparatus according to claim 4 wherein said loading means (35) includes:

(a) a vertically disposed auxiliary structure of generally rectangular configuation mounted on the support frame defining a loading zone into which a piece-carrier is moved by said first actuating means;

(b) an actuating device (37) attached to each corner of said auxiliary structure having a sliding element (36) mounted therein movable to and from positions of operative association with said cylindrical elements (12);

(c) means forming the outer-end of each sliding element (36) defining a pair of spaced and horizontally disposed support fingers (38) for supporting a ring of elastic thereon and depositing the same onto the outer surface of a tubular garment supported by the tubular elements upon simultaneous actuation of each said actuating device (37).

6. The apparatus according to claim 5 wherein each of said cylindrical elements (12) includes a turnover element (39) operatively associated therewith for folding the edge of the garment over the ring of elastic prior to moving the piece-carrier from the loading zone to the sewing zone.

7. The apparatus according to claim 1 wherein said first actuating means includes a pneumatic cylinder (23) pivotably mounted on the supporting frame having a piston rod (25) operatively connected to a bracket (26) fixed on said plate (7).

8. The structure according to claim 1 wherein said apparatus includes a trimming device comprising:

(a) a support block (49) slidably mounted on the sewing machine for movement toward and away from the sewing zone;

(b) a cutter blade (47) operatively associated with a counter-blade (48) on said support block (49) for trimming the edge of the tubular garment while being advanced through the sewing zone; and (c) a transverse blade (54) mounted on said support block (49) for cutting the edge of the tubular garment in a direction perpendicular to the direction of sewing to prevent the cutting of a fabric ring by said cutter and counter-blades (47, 48).

9. The structure according to claim 8 wherein said trimming device includes a pivotably mounted sensor element (55) operatively associated with the said support block (49) for effecting withdrawal of said sensing element and trimming device from the path of the seam upon completion of each sewing cycle.

* * * * *

UNITED STATES PATENT AND TRADEMARK OFFICE

CERTIFICATE OF CORRECTION

PATENT NO. : 4,265,187

DATED : May 5, 1981

INVENTOR(S) : Giancarlo Della Torre

It is certified that error appears in the above—identified patent and that said Letters Patent is hereby corrected as shown below:

On the face of the patent:

At [75] After "Giancarlo" delete 'D.' and insert --Della--

At [73] After "S.p.A.," delete 'Biassono' and insert --Milan--

Signed and Sealed this

*Twenty-fourth* Day of *May 1983*

[SEAL]

*Attest:*

DONALD J. QUIGG

*Attesting Officer* *Acting Commissioner of Patents and Trademarks*